US011018478B2

(12) United States Patent
Sunshine

(10) Patent No.: US 11,018,478 B2
(45) **Date of Patent: *May 25, 2021**

(54) ION GENERATOR DEVICE SUPPORT

(71) Applicant: PLASMA AIR INTERNATIONAL, INC, Stamford, CT (US)

(72) Inventor: Lawrence T. Sunshine, Rye Brook, NY (US)

(73) Assignee: PLASMA AIR INTERNATIONAL, INC, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/594,633

(22) Filed: Oct. 7, 2019

(65) Prior Publication Data

US 2020/0112147 A1 Apr. 9, 2020

Related U.S. Application Data

(63) Continuation of application No. 16/214,999, filed on Dec. 10, 2018, now Pat. No. 10,439,370, which is a (Continued)

(51) Int. Cl.
*H01T 23/00* (2006.01)

(52) U.S. Cl.
CPC ..... *H01T 23/00* (2013.01)

(58) Field of Classification Search
CPC ..... A61N 1/44; A61N 1/0428; A61N 1/325; A61N 2005/0644; A61N 2005/0652;

(Continued)

(56) References Cited

U.S. PATENT DOCUMENTS 3,551,743 A 12/1970 Koepke et al.
3,734,342 A 5/1973 Patterson (Continued)

FOREIGN PATENT DOCUMENTS

CA 2 108 790 C 2/2002
JP 2004-012087 A 1/2004

(Continued)

OTHER PUBLICATIONS

Daniels S.L., ""On the Ionization of Air for Removal of Noxious Effluvia" (Air Ionization of Indoor Environments for Control of Volatile and Particulate Contaminants With Nonthermal Plasmas Generated by Dielectric-Barrier Discharge)", IEEE Transactions on Plasma Science 30(4):1471-1481 (Aug. 2002).

(Continued)

*Primary Examiner* — Tracie Y Green
(74) *Attorney, Agent, or Firm* — Scully, Scott, Murphy & Presser, P.C.

(57) ABSTRACT

The present disclosure is directed to ion generator device supports. An ion generator device support is configured to retain an ion generator device, the ion generator device having a first portion containing exposed electrodes and a second portion, the support includes a first wall, a second wall extending orthogonally from the first wall and a third wall extending orthogonally from the first wall opposed to the second wall, wherein the third wall extends a smaller distance from the first wall than the second wall, wherein the third wall comprises an orthogonal extension section that extends from the edge of the third wall towards the second wall and is substantially parallel to the first wall.

17 Claims, 6 Drawing Sheets

Related U.S. Application Data continuation of application No. 15/989,786, filed on May 25, 2018, now Pat. No. 10,153,623, which is a continuation of application No. 15/824,191, filed on Nov. 28, 2017, now Pat. No. 9,985,421, which is a continuation of application No. 15/601,400, filed on May 22, 2017, now Pat. No. 10,014,667, which is a continuation of application No. 14/983,846, filed on Dec. 30, 2015, now Pat. No. 9,660,425.

(58) Field of Classification Search

CPC ..... A61N 2005/0663; A61N 5/0616; A61N 1/10; A61N 1/322; A61N 5/1028; H01T 23/00; A61L 9/22

See application file for complete search history.

(56) References Cited

U.S. PATENT DOCUMENTS

| | | | | |
|---|---|---|---|---|
| 3,875,461 | A | 4/1975 | Richardson et al. | |
| 4,048,667 | A | 9/1977 | Brennecke | |
| 4,107,755 | A | 8/1978 | Kiefer | |
| 4,477,263 | A | 10/1984 | Shaver et al. | |
| 4,809,127 | A | 2/1989 | Steinman et al. | |
| 5,550,703 | A | 8/1996 | Beyer et al. | |
| 5,570,266 | A | 10/1996 | Testone | |
| 6,744,617 | B2 | 6/2004 | Fujii | |
| 6,807,044 | B1 | 10/2004 | Vernitsky et al. | |
| 6,850,403 | B1 | 2/2005 | Gefter et al. | |
| 6,987,658 | B2 | 1/2006 | Lu et al. | |
| 7,132,010 | B2 | 11/2006 | Carlsson | |
| 7,391,598 | B2 | 6/2008 | Fujiwara et al. | |
| 7,497,898 | B2 | 3/2009 | Sato et al. | |
| 7,695,552 | B2 | 4/2010 | Sato et al. | |
| 7,749,313 | B2 | 7/2010 | Byon et al. | |
| 7,948,733 | B2 | 5/2011 | Hashimoto | |
| 8,018,710 | B2 | 9/2011 | Fujita et al. | |
| 8,072,731 | B2 | 12/2011 | Shimada et al. | |
| 8,106,367 | B2 | 1/2012 | Riskin | |
| 8,134,821 | B2 | 3/2012 | Fukai et al. | |
| 8,564,924 | B1 | 10/2013 | Waddell et al. | |
| 8,710,456 | B2 | 4/2014 | Klochkov et al. | |
| 8,861,167 | B2 | 10/2014 | Waddell et al. | |
| 8,861,168 | B2 | 10/2014 | Waddell et al. | |
| 8,873,215 | B2 | 10/2014 | Waddell | |
| 9,025,303 | B2 | 5/2015 | Waddell et al. | |
| 9,168,538 | B2 | 10/2015 | Waddell | |
| 9,289,779 | B2 | 3/2016 | Waddell et al. | |
| 9,478,948 | B2 | 10/2016 | Waddell | |
| 9,509,125 | B2 | 11/2016 | Waddell et al. | |
| 9,660,425 | B1 | 5/2017 | Sunshine | |
| 9,847,623 | B2 | 12/2017 | Sunshine | |
| 10,153,623 | B2 | 12/2018 | Sunshine | |
| 10,439,370 | B2 * | 10/2019 | Sunshine | H01T 23/00 |
| 2004/0145853 | A1 | 7/2004 | Sekoguchi et al. | |
| 2005/0117269 | A1 | 6/2005 | Nakasone et al. | |
| 2006/0022495 | A1 | 2/2006 | Dehli | |
| 2007/0126363 | A1 | 6/2007 | Sato et al. | |
| 2008/0098895 | A1 | 5/2008 | Sato et al. | |
| 2008/0202335 | A1 | 8/2008 | McKinney et al. | |
| 2008/0278881 | A1 | 11/2008 | Kato et al. | |
| 2009/0103229 | A1 | 4/2009 | Jung et al. | |
| 2009/0321544 | A1 | 12/2009 | Akisada et al. | |
| 2010/0241306 | A1 | 9/2010 | Akisada et al. | |
| 2012/0026641 | A1 * | 2/2012 | Tsuda | H01T 23/00 361/231 |
| 2012/0056541 | A1 | 3/2012 | Mamiya et al. | |
| 2012/0154973 | A1 | 6/2012 | Vaynerman et al. | |
| 2012/0287551 | A1 | 11/2012 | Waddell et al. | |
| 2013/0232807 | A1 | 9/2013 | Robert et al. | |
| 2013/0336838 | A1 | 12/2013 | Waddell | |
| 2014/0029155 | A1 | 1/2014 | Waddell | |
| 2014/0076162 | A1 | 3/2014 | Waddell et al. | |
| 2014/0078639 | A1 | 3/2014 | Waddell et al. | |
| 2014/0209799 | A1 | 7/2014 | Waddell | |
| 2014/0338535 | A1 | 11/2014 | Pucciani et al. | |
| 2014/0373817 | A1 | 12/2014 | Waddell et al. | |
| 2014/0375208 | A1 | 12/2014 | Waddell | |
| 2015/0253019 | A1 | 9/2015 | Waddell | |

FOREIGN PATENT DOCUMENTS

| | | | |
|---|---|---|---|
| JP | 2005-142131 | A | 6/2005 |
| JP | 2005-337610 | A | 12/2005 |
| JP | 2008-089301 | A | 4/2008 |
| WO | 2008/004454 | A1 | 1/2008 |
| WO | 2008/054125 | A1 | 5/2008 |

OTHER PUBLICATIONS

Integrate Sterionizer™ Window into your A/C System. Datasheet [online]. FILT AIR Ltd, Jan. 2009 [Retrieved on Jan. 5, 2017] Retrieved from the Internet: < http://www.sterionizer.com/wp-content/uploads/downloads/window/2012_06_26_09_04_52/document.pdf> (4 pages) (Jun. 17, 2012).

"Wide Area Ionizer" is the choice for your production site. Datasheet [online]. SUNX Limited, Mar. 2009 [retrieved on Sep. 18, 2015]. Retrieved from the Internet: <https://www.panasonic-electric-works.com/cps/rde/xbcr/pewnew/ds_63165_1000_en_ert.pdf> (8 pages) (Mar. 2009).

Installation, Operation & Maintenance Manual. Datasheet [online]. Plasma Air International, [Retrieved on Jan. 7, 2016] Retrieved from the Internet: < http://www.plasma-air.com/sites/default/files/Plasma_Air_Plasma_BAR_IOM_Manual_0.pdf> (4 pages) (Jul. 2014).

Ionization Product Submittal. Datasheet [online]. Plasma Air International, [Retrieved on Jan. 7, 2016] Retrieved from the Internet: < http://www.plasma-air.com/sites/default/files/Plasma_Air_BAR_Submittal_0.pdf> (1 page) (2014).

Ionizer. Datasheet [online]. SMC Corporation, [retrieved on Jan. 5, 2017] Retrieved from the Internet: <http://content2.smcetech.com/pdf/IZS31.pdf> (35 pages) (2007).

Air Purification System Models IG-40 & IG-40R. Datasheet, Bioclimatic Air Systems, LLC., Jul. 2009 [retrieved on Jan. 5, 2017] (12 pages) (Jul. 2009).

Sterionizer. Datasheet, FILT AIR Ltd, Oct. 2005 [retrieved on Sep. 30, 2015] (2 pages) (Oct. 2005).

Static Ionizer is for use in cell manufacturing facilities. Press Release [online]. Thomasnet Aug. 28, 2008 [Retrieved on Jan. 5, 2017] Retrieved from the Internet: < http://news.thomasnet.com/fullstory/static-ionizer-is-for-use-in-cell-manufacturing-facilities-819753> (5 pages) (Aug. 2008).

Nishikawa, K. et al., "Indoor Suspended Allergen Inactivation Technology Using Cluster Ions Generated by Discharge Plasma", Sharp Technical Journal, Aug. 2004, No. 89, pp. 55-60.

United States Notice of Allowance dated Mar. 1, 2017 received in related U.S. Appl. No. 14/983,846.

United States Notice of Allowance dated Oct. 7, 2016 received in related U.S. Appl. No. 14/983,846.

International Search Report and Written Opinion dated Feb. 6, 2017 received in International Application No. PCT/US16/69080.

United States Office Action dated Aug. 28, 2017 received in related U.S. Appl. No. 15/601,400.

International Search Report and Written Opinion dated May 18, 2017 received in International Application No. PCT/US17/14103.

Notice of Allowance dated Jan. 31, 2018 received in related U.S. Appl. No. 15/824,191.

Notice of Allowance dated Mar. 9, 2018 received in related U.S. Appl. No. 15/601,400.

Notice of Allowance dated Aug. 3, 2018 received in related U.S. Appl. No. 15/989,786.

Notice of Allowance dated May 17, 2019 received in related U.S. Appl. No. 16/214,999.

Office Action dated Jan. 24, 2019 received in related U.S. Appl. No. 16/214,999.

* cited by examiner

ION GENERATOR DEVICE SUPPORT

CROSS-REFERENCE TO RELATED APPLICATIONS

The present application is a continuation of U.S. patent application Ser. No. 16/214,999 filed on Dec. 10, 2018, which is a continuation of U.S. patent application Ser. No. 15/989,786 filed on May 25, 2018, now U.S. Pat. No. 10,153,623 issued on Dec. 11, 2018, which is a continuation application of U.S. patent application Ser. No. 15/824,191 filed on Nov. 28, 2017, now U.S. Pat. No. 9,985,421 issued on May 29, 2018, which is a continuation of U.S. patent application Ser. No. 15/601,400 filed on May 22, 2017, now U.S. Pat. No. 10,014,667 issued on Jul. 3, 2018, which is a continuation of U.S. patent application Ser. No. 14/983,846 filed on Dec. 30, 2015, now U.S. Pat. No. 9,660,425 issued on May 23, 2017, the entire contents of which are incorporated herein by reference.

FIELD OF THE DISCLOSURE

The present disclosure is directed to ion generator device supports (enclosures, mounts and apparatus) that are configured to hold one or more ion generator devices. The present disclosure is further directed to ion generator device supports that are configured to be placed on, in, or a combination of on and in heating, ventilating and air-conditioning (HVAC) elements, including but not limited to Roof Top Units (RTUs), air handling units (AHU), fan coil units (FCU), Variable Refrigerant Volume Units (VRVU), Variable Refrigerant Flow Units (VRFU) and Packaged Terminal Air Conditioner (PTAC) units, and also including heat pumps, ducts, air inlets, and air outlets.

BACKGROUND OF THE DISCLOSURE

An air ionizer typically includes electrodes to which high voltages are applied. Gas molecules near the electrodes become ionized when they either gain or lose electrons. Because the ions take on the charge of the nearest electrode, and like charges repel, they are repelled from that electrode. In typical air ionizers, an air current is introduced to the device in order to carry the ions away from the electrodes to a "target region" where an increased ion content is desired.

Ions in the air are attracted to objects carrying an opposite charge. When an ion comes in contact with an oppositely charged object, it exchanges one or more electrons with the object, lessening or eliminating the charge on the object. Thus, ions in the air can reduce contamination of objects in the environment.

SUMMARY OF THE DISCLOSURE

The present disclosure is directed to ion generator device supports. An ion generator device support is configured to retain an ion generator device, the ion generator device having a first portion containing exposed electrodes and a second portion, the support includes a first wall, a second wall extending orthogonally from the first wall and a third wall extending orthogonally from the first wall opposed to the second wall, wherein the third wall extends a smaller distance from the first wall than the second wall, wherein the third wall comprises an orthogonal extension section that extends from the edge of the third wall towards the second wall and is substantially parallel to the first wall.

BRIEF DESCRIPTION OF THE DRAWINGS

The present disclosure will be better understood by reference to the following drawings of which.

DETAILED DESCRIPTION OF THE DISCLOSURE

The disclosure includes an ion generator device support that can be used to support ion generator devices for any suitable purpose, including placement on, in, or a combination of on and in heating, ventilating and air-conditioning (HVAC) elements, including but not limited to Roof Top Units (RTUs), air handling units (AHU), fan coil units (FCU), Variable Refrigerant Volume Units (VRVU), Variable Refrigerant Flow Units (VRFU) and Packaged Terminal Air Conditioner (PTAC) units, and also including heat pumps, ducts, air inlets, and air outlets.

Other suitable purposes for use of the disclosed ion generator device and ion generator device support enclosures is placement on, in, or a combination of on and in hand dryers, hair dryers, vacuum cleaners, variable air volume diffusers, refrigerators, freezers, automobile ventilation elements (including cars, trucks, recreational vehicles, campers, boats and planes) and light fixtures.

As used herein, the term "resilient" refers to the capacity of a material to spring back, rebound or return substantially to its original, or nearly original, shape or position after being compressed, deformed, distorted, bent or stretched.

As used herein, the term "about" indicates that the value listed may be somewhat altered, as long as the alteration does not result in nonconformance of the process or structure to the illustrated embodiment. For example, for some elements the term "about" can refer to a variation of ±0.1%, for other elements, the term "about" can refer to a variation of ±1% or ±10%, or any point therein.

As used herein, the term "substantially" refers to the complete or nearly complete extent or degree of an action, characteristic, property, state, structure, item, or result. For example, an object that is "substantially" parallel would mean that the object is either completely parallel or nearly completely parallel. The exact allowable degree of deviation from absolute completeness may in some cases depend on the specific context. However, generally speaking the nearness of completion will be so as to have the same overall result as if absolute and total completion were obtained.

Figure 1A:
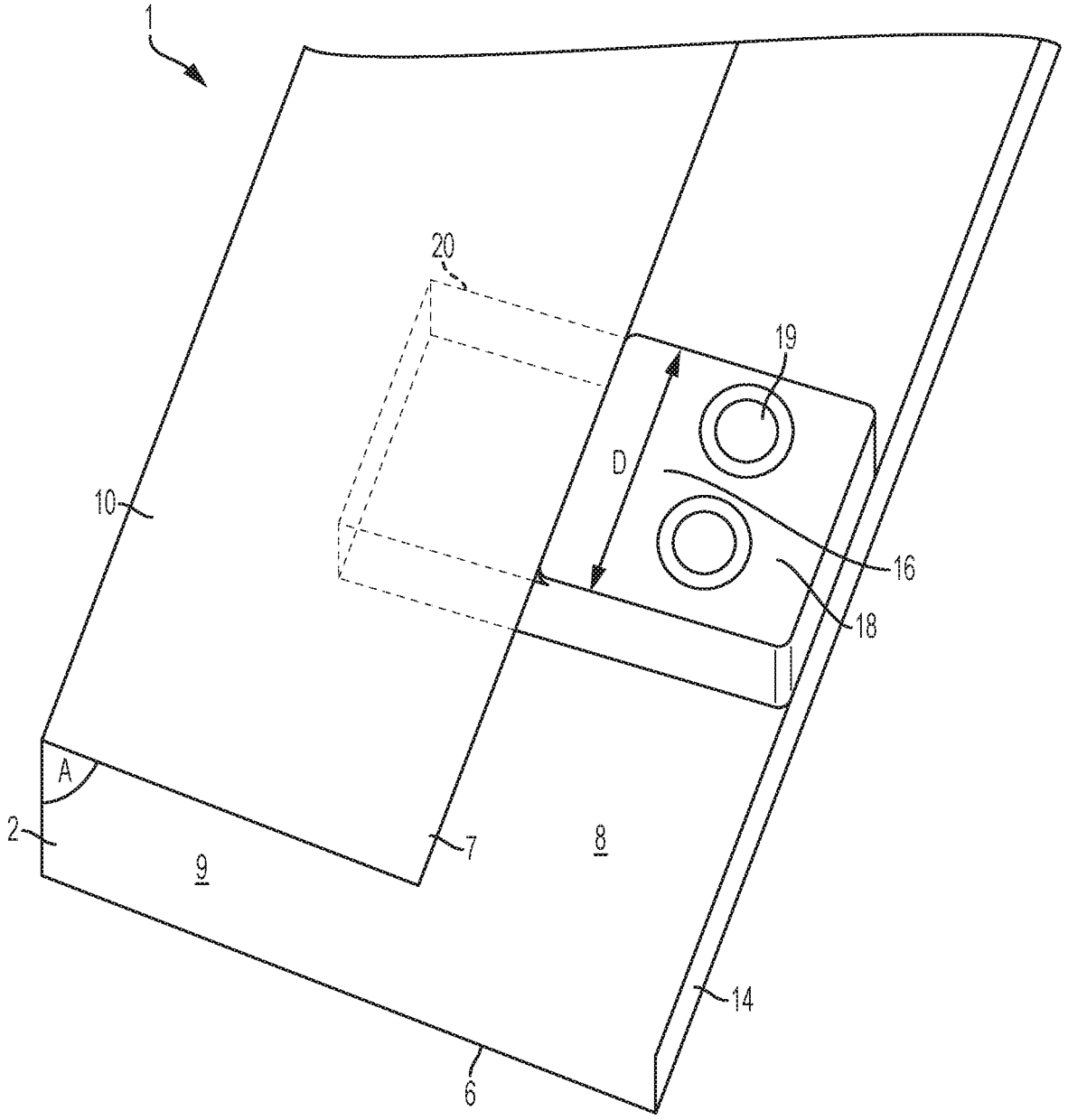
FIG. 1A is a perspective view of an embodiment of the ion generator device support with an ion generator device retained therein.

FIG. 1A of the present disclosure is a perspective view of one embodiment of the present disclosure. Ion generator device support 1 includes a first wall 2, a second wall 6 extending orthogonally from the first wall 2, a third wall 10 that extends orthogonally from the first wall 2 opposed to the second wall 6 and a fourth wall 14 that extends orthogonally from the second wall 6. Ion generator device support 1 includes an open cavity 8 formed between fourth wall 14 and third wall 10. Open cavity 8 is configured to accommodate therein an ion generator installed in an operable position. FIG. 1A shows, for example, ion generator 16 installed in open cavity 8. Although third wall 10 is shown as facing upwards in the figures, this is for illustrative purposes only. Generally, the ion generator device support 1 will be installed with open cavity 8 facing downwards. However, ion generator device support 1 can be rotated and moved into any suitable orientation.

As can be seen from FIG. 1A, the third wall 10 extends a smaller distance from first wall 2 as compared to second wall 6. Although third wall 10 is illustrated as extending a majority of the distance between first wall 2 and fourth wall 14, third wall 10 can be any suitable distance that is smaller than the distance from the first wall 2 to the fourth wall 14 to configure open cavity 8 to accept an ion generator therein.

As shown in FIG. 1A and subsequent figures, the first wall 2 is substantially parallel to fourth wall 14, but, in other embodiments, first wall 2 and fourth wall 14 can be formed at relative angels to each other. Also as shown in FIG. 1A and subsequent figures, the first wall 2 and second wall 6 are substantially perpendicular to each other, but, in other embodiments, first wall 2 and second wall 6 can be formed at other relative angles to each other.

Fourth wall 14, second wall 6, first wall 2 and third wall 10 can be formed of the same material, or of different materials from each other. If the ion generator device support is formed of the same material, the fourth wall 14, second wall 6, first wall 2 and third wall 10 can be formed of a single piece of the same material. The same or different materials can be any suitable material, including suitable plastics, such as polycarbonates, vinyls, polyethylenes, polyvinyl chloride, polypropylene, acrylonitrile butadiene styrene (ABS) and polystyrene, suitable metals including galvanized steel, stainless steel and aluminum, natural and synthetic rubbers, and combinations thereof.

One or more of fourth wall 14, second wall 6, first wall 2 and third wall 10 can be formed of a resilient material, such that when they are compressed, deformed, distorted, bent or stretched, they have the capacity to spring back, rebound or return substantially to its original, or nearly original, shape or position.

In this embodiment one ion generator device 16 is shown, but in other embodiments, ion generator device support 1 can include two ion generator devices up to several tens of ion generator devices.

Figure 1B:
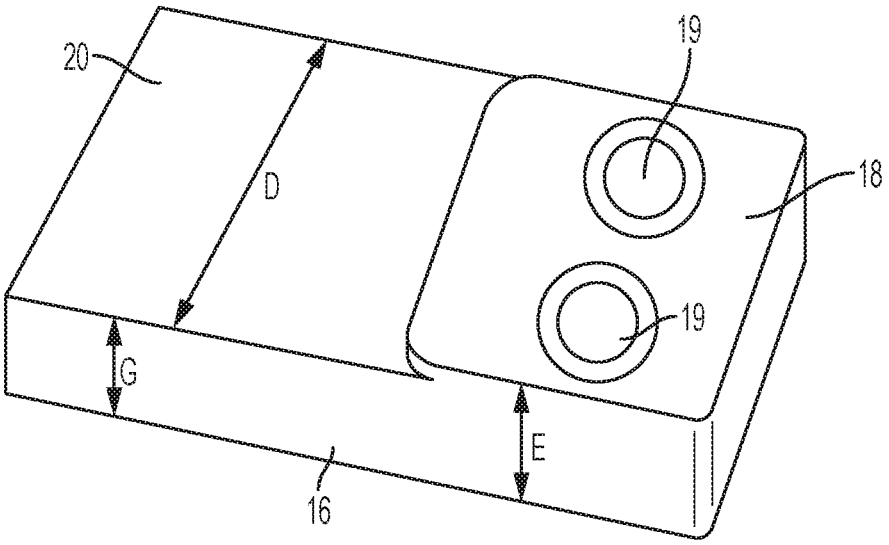
FIG. 1B is a perspective view of an ion generator device.

FIG. 1B illustrates one type of ion generator device 16 that can be installed in the ion generator device support of the present invention. Ion generator device 16 includes a first portion 18 having a thickness E larger than a thickness G of a second portion 20. The thickness of third wall 10 is configured to be roughly equal to the difference in thickness between the first portion 18 and second portion 20. First portion 18 includes exposed electrodes 19. In this embodiment ion generator 16 includes two needle point electrodes 19, but in other embodiments ion generator device 16 can include one, three or more exposed electrodes.

Referring again to FIG. 1A, third wall 10 is configured to extend over the second portion 20 of ion generator device 16. The first portion 18 of ion generator device 16 is installed in open cavity 8 with the electrode 19 exposed between an edge 7 of third wall 10 and the fourth wall 14.

Open cavity 8 is configured so that ion generator device 16 can be placed within it, exposing the first portion 18 of ion generator device 16, and second portion 20 contained within closed cavity 9, such that ion generator device 16 can be substantially retained in ion generator support 1. Ion generator device 16 can be placed within open cavity 8 and be maintained within open cavity 8 without the use of additional hardware or fastening mechanisms.

The ion generator device 16 is a device capable of producing positive ions, negative ions or a combination of positive ions and negative ions, such as from an ionizing needle, from an ionizing brush and from an ionizing tube, at various intensities as desired. In some embodiments, ion generator device 16 can include ionizing needle elements, which are rod shaped and come to a point at one end. In other embodiments, the ion generator device 16 can include ionizing brushes, which can contain a plurality of bristles or fibers formed of a conductive material. In other embodiments, ion generator device 16 can include ionizing tubes, which includes a tube that is surrounded by at least one electrode that is capable of producing positive ions, negative ions or a combination of positive ions and negative ions. Each of the ionizing needle, ionizing brush and ionizing tube can include components formed of a material sufficient to emit ions, such as, for example, a conductive metal, a conductive polymer, a conductive semi-fluid and a carbon material.

Ion generator device 16 can be used to adjustably create various ion concentrations in a given volume of air, as desired. Ion generator device 16 can also be used to produce about equal amounts of positive and negative ions, regardless of airflow and other environmental conditions, as desired. In some embodiments, ion generator device 16, can be used to create about $10^9$ ions/second or more. Along with producing ions, the disclosed ion generator devices can also reduce static electricity when placed on, in or a combination of on and in any of the elements or items listed above.

A power supply (not shown) provides power to each ion generator device 16 to produce positive ions, negative ions or a combination of positive ions and negative ions. The power supply can provide any DC or AC supply, at any suitable voltage and current.

Figure 2:
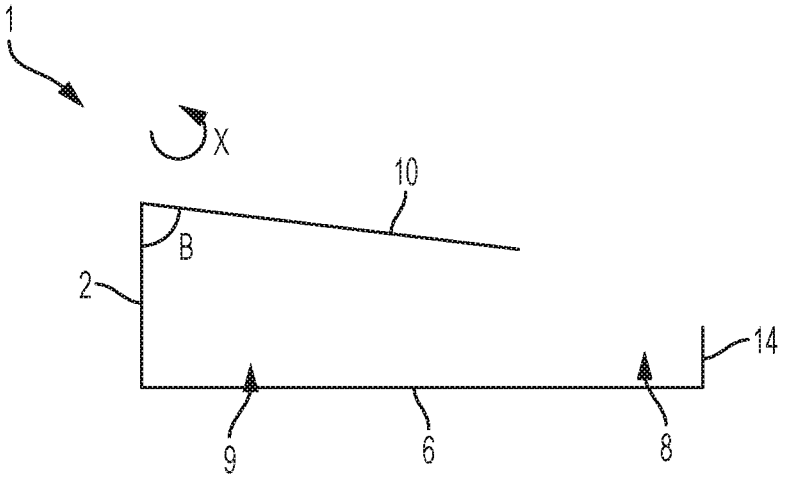
FIG. 2 is a side view of an embodiment of the ion generator device support without an ion generator device retained therein.

FIG. 2 of the present disclosure illustrates a side view of an ion generator device support 1 without the inclusion of an ion generator device. As shown in FIG. 2, the angle B formed between first wall 2 and third wall 10 is less than 90° and less than angle A of FIG. 1A and FIG. 3, but can be at any angle such that the space between (1) a portion of the third wall 10 nearest the fourth wall 14 and (2) the second wall 6 is less than a thickness G of an ion generator device. The Angle A can be about 90°, just more than about 90° or less than about 90°.

In order to install an ion generator into device support 1, third wall 10 is rotated in the X direction, causing second wall 6 of ion generator device support 1 to become further away from third wall 10 to allow for the insertion of the ion generator device into device support 1. When third wall 10 is rotated in the X direction, third wall 10 would resiliently attempt to rotate back to its resting shape shown in FIG. 2. This effort to rotate back to the resting shape in FIG. 2 would apply a compressive force between third wall 10 and second wall 6 against the ion generator device 16 that was previously inserted into the ion generator device support 1. This force Y is illustrated in FIG. 3.

Figure 3:
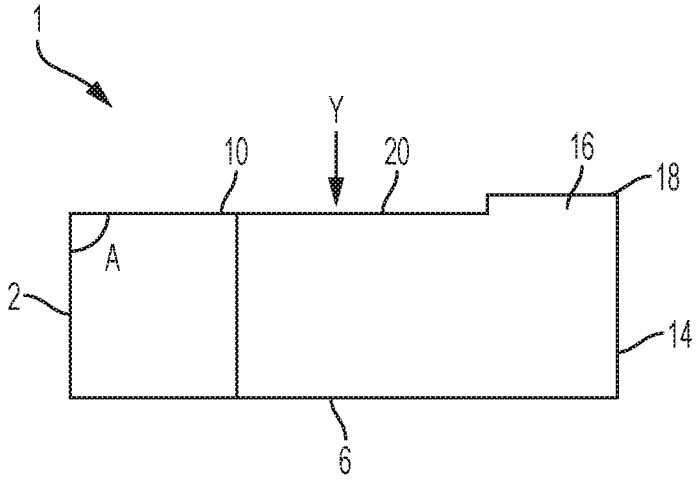
FIG. 3 is a side view of an embodiment of the ion generator device support with an ion generator device retained therein.

FIG. 3 is a side view of ion generator device support 1 after third wall 10 is released from rotating in the X direction and is now applying a force in the Y direction against ion generator device 16 due to the resiliency of third wall 10. The force in the Y direction compresses ion generator device 16 between third wall 10 and second wall 6, to substantially maintain the position of ion generator device 16 in ion generator device support 1.

In still other embodiments, fourth wall 14 can be a resilient material that can apply a force that is substantially parallel to second wall 6. In this embodiment, both fourth wall 14 and third wall 10 can apply force to an ion generator device 16 to retain the ion generator device 16 within the ion generator device support.

Figure 4:
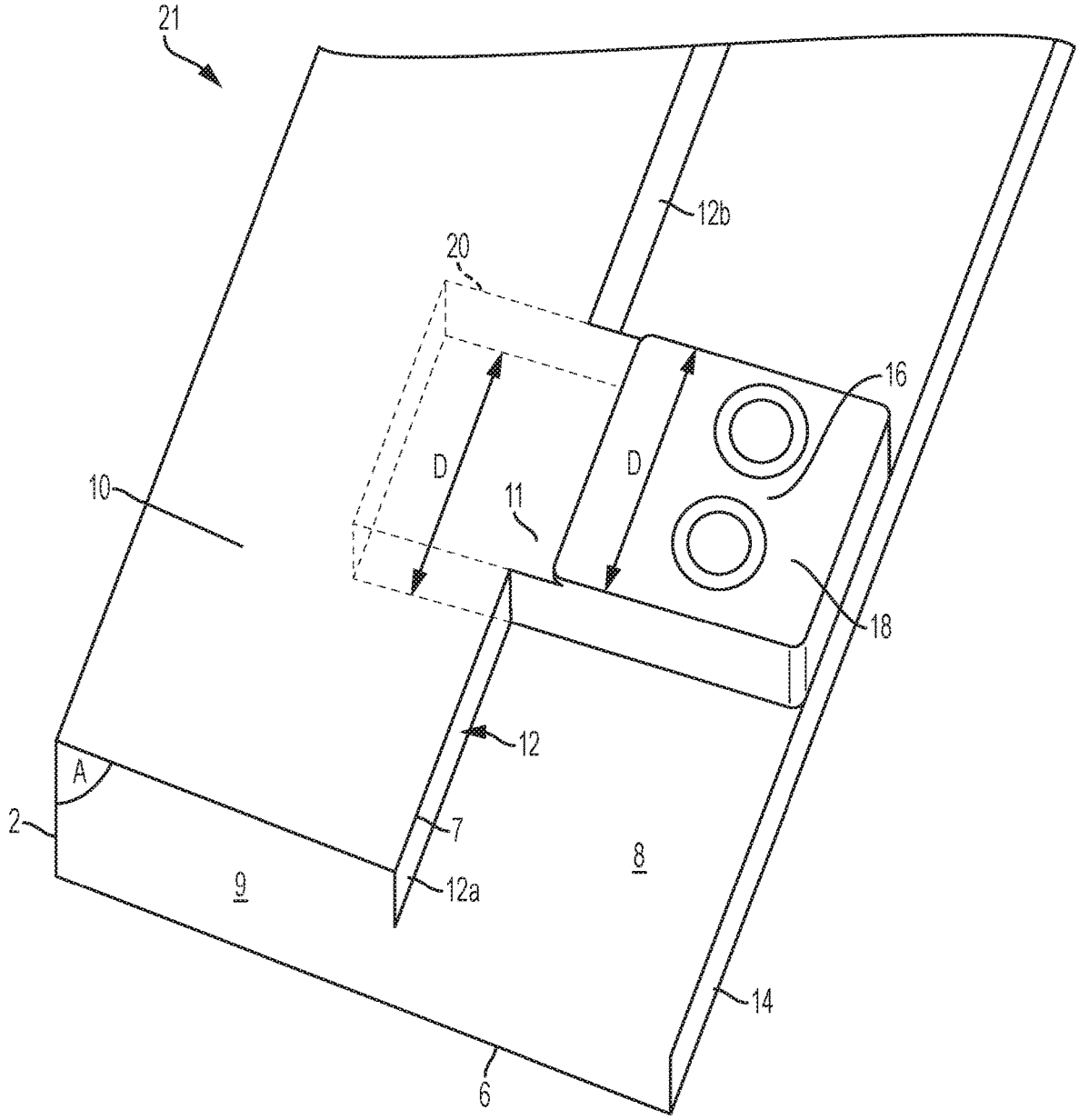
FIG. 4 is a perspective view of an embodiment of the ion generator device support with an ion generator device retained therein.

In another embodiment of an ion generator device support 21 shown in FIG. 4, third wall 10 includes a lateral extension section 11 and an orthogonal extension section 12. Lateral extension section 11 is configured to extend over at least a part of the second portion 20 of ion generator device 16. In this embodiment, third wall 10 is configured to extend over a percentage of second portion 20 while lateral extension section 11 is configured to extend over the remaining percentage of second portion 20. Orthogonal extension section 12 extends from edge 7 substantially parallel to first wall 2. Orthogonal extension section 12 has two portions, 12*a* and 12*b* that are spaced approximately to a widthwise dimension D of the ion generator 16 in order to restrict the ion generator device 16 from moving laterally.

The dimensions of lateral extension section 11 and orthogonal extension section 12 can be configured as desired based on different dimensions of different ion generator devices.

Ion generator device support 21 can support several ion generators by having multiple sections 11 and/or 12 so that each ion generator device 16 has a lateral extension section 11 over a second portion 20 of each ion generator device 16 and an orthogonal extension section 12 on at least one side of each ion generator device 16.

In this embodiment, third wall 10, fourth wall 14 and orthogonal section 12 form an open cavity 8 and second wall 6, third wall 10, first wall 2 and orthogonal section 12 form a closed cavity 9. Although the cavities state "open" and "closed", they are substantially open and substantially closed as shown in the figures.

Figure 5:
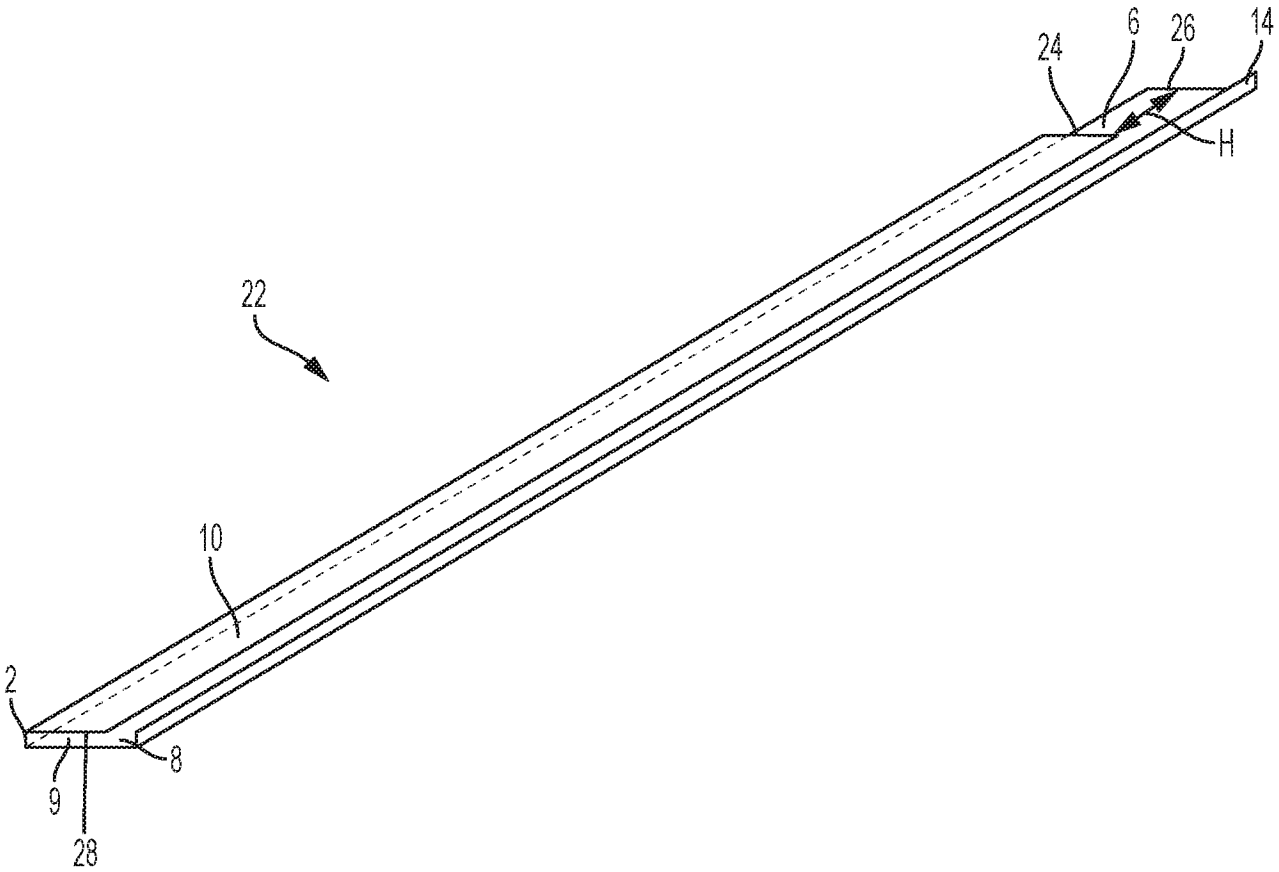
FIG. 5 is a perspective view of an embodiment of the ion generator device support.

Another embodiment of an ion generator device support is shown in FIG. 5. Ion generator device support 22 is similar to ion generator device support 1, with a second wall 6 having an extension section 26 of dimension H not opposed by third wall 10.

Ion generator device support 22 includes a first end 24 and the second end 28 of third wall 10. The distance between first end 24 and second end 28 can be any suitable length capable of retaining one or more ion generator devices on, in, or a combination of on and in HVAC elements, including but not limited to RTUs, AHUs, FCUs, VRVUs, VRFUs, and PTAC units, and also including heat pumps, ducts, air inlets, and air outlets. For example the distance between first end 24 and second end 28 can be between about six inches and about fifteen feet, with this range including all distances within the range. In other embodiments, the distance between first end 24 and second end 28 can be between about eighteen inches and about ten feet.

Figure 6:
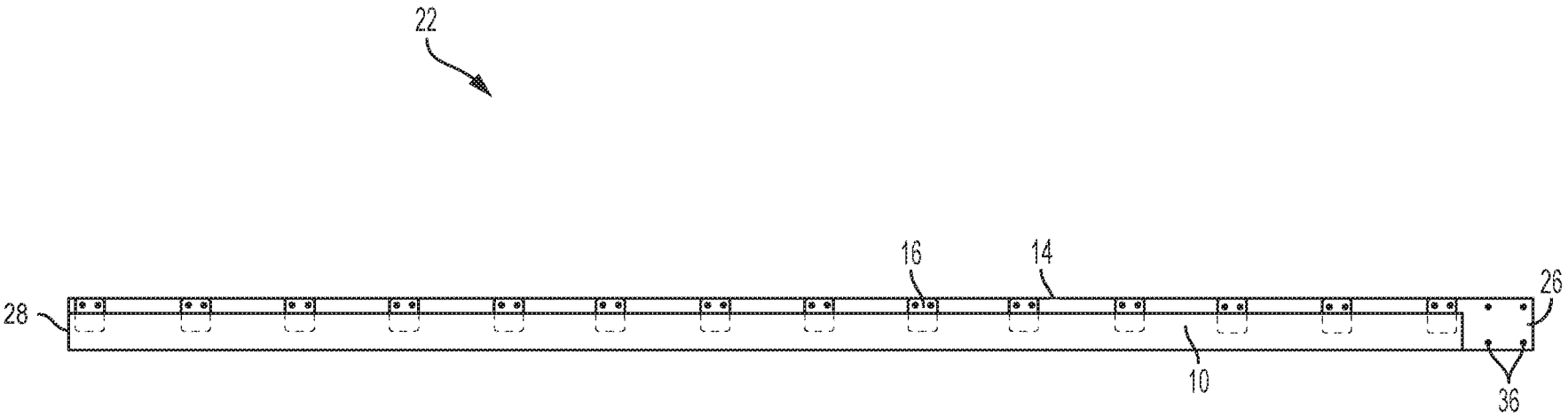
FIG. 6 is a top view of an embodiment of the ion generator device support with ion generator devices retained therein.

FIG. 6 shows a plurality of ion generator devices 16 installed in ion generator device support 22. The ion generator device support 22 in FIG. 6 shows fourteen ion generator devices 16, but in other embodiments ion generator device support 1 can include a single ion generator device up to several tens of ion generator devices.

The ion generator device support 22 shown in FIGS. 5 and 6 can be used to support ion generator devices and can be placed on, in, or a combination of on and in HVAC elements as well as on and in heat pumps, ducts, air inlets, and air outlets. For instance, as shown in FIG. 6, ion generator device support 22 can be secured within an HVAC duct, unit or RTU using holes 36 in extension section 26 by any suitable connection means, such as a screw, nail, clip, bracket, adhesive, rivet, grommet, bolt, magnetic connectors, hook and loop fasteners, straps and the like.

In other embodiments, other portions of ion generator device support 22 can be used to secure the ion generator device support 22 to varying locations within, on or in a combination of in and on an HVAC element and within, on or in a combination of in and on heat pumps, ducts, air inlets, air outlets, AHUs and RTUs. For example, one or more brackets can be attached to third wall 10 or second wall 6 that can secure the ion generator device support 22 to varying locations within, on or in a combination of in and on an HVAC element and within, on or in a combination of in and on heat pumps, ducts, air inlets, air outlets, AHUs and RTUs.

The described embodiments and examples of the present disclosure are intended to be illustrative rather than restrictive, and are not intended to represent every embodiment or example of the present disclosure. While the fundamental novel features of the disclosure as applied to various specific embodiments thereof have been shown, described and pointed out, it will also be understood that various omissions, substitutions and changes in the form and details of the devices illustrated and in their operation, may be made by those skilled in the art without departing from the spirit of the disclosure. For example, it is expressly intended that all combinations of those elements and/or method steps which perform substantially the same function in substantially the same way to achieve the same results are within the scope of the disclosure. Moreover, it should be recognized that structures and/or elements and/or method steps shown and/or described in connection with any disclosed form or embodiment of the disclosure may be incorporated in any other disclosed or described or suggested form or embodiment as a general matter of design choice. Further, various modifications and variations can be made without departing from the spirit or scope of the disclosure as set forth in the following claims both literally and in equivalents recognized in law.

What is claimed is:

1. An ion generator device support configured to retain a plurality of ion generator devices, each ion generator device having ionizing elements, the support comprising:

a first wall;

a second wall extending orthogonally from the first wall; and a third wall opposing the second wall, the third wall being substantially parallel to the second wall, wherein, when the plurality of ion generator devices are is retained within the ion generator device support, at least part of the ion generator devices is between the second wall and the third wall and the plurality of ion generator devices are aligned, and wherein the ionizing elements of each ion generator device are exposed.

2. The support of claim 1, wherein a distance between adjacent ion generator devices is the same for each of the plurality of ion generator devices.

3. The support of claim 1, further comprising a plurality of sections extending between the third wall and the second wall, wherein when the plurality of ion generator devices are retained within the ion generator device support, the plurality of sections are between the ion generator devices.

4. The support of claim 1, wherein each ion generator device is coupleable to a power supply.

5. The support of claim 4, wherein power supplied by the power supply is adjustable to adjustably create various ion concentrations from the ion generator devices.

6. The support of claim 4, wherein each ion generator device provides a combination of positive ions and negative ions.

7. The support of claim 4, wherein each ion generator device provides at least $10^9$ ions/second.

8. The support of claim 4, wherein the ionizing elements are ionizing needles.

9. The support of claim 1, wherein the third wall is configured to rotate from an initial position to enable the installation of each ion generator device into the ion generator device support.

10. The support of claim 9, wherein after the third wall rotates to enable the installation, the third wall is configured to rotate back to the initial position.

11. The support of claim 1, wherein the ion generator device support is configured to be mounted in an HVAC element.

12. The support of claim 11, wherein the HVAC element is selected from a group consisting of an air handling unit (AHU), a fan coil unit (FCU), a roof top unit (RTU), an air duct, air inlet and an air outlet.

13. The support of claim 1, wherein a length of the ion generator device support from a first end to a second end is between about six inches and about fifteen feet.

14. The support of claim 13, wherein a length of the second wall from the first end to the second end is greater than the length of the third wall from the first end to the second end.

15. The support of claim 14, wherein the second wall has mounting holes.

16. The support of claim 15, wherein the mounting holes are positioned in the second wall in an area that is not opposed to the third wall.

17. The support of claim 1, wherein the plurality of ion generator devices are aligned with respect to an edge of the third wall.

* * * * *